US006276369B1

(12) United States Patent
Rogers

(10) Patent No.: US 6,276,369 B1
(45) Date of Patent: Aug. 21, 2001

(54) HAIR BAND SYSTEM WITH STORAGE AND DISPLAY DEVICE

(76) Inventor: Bruce Rogers, 19 S. Bank St., Ste. 406, Philadelphia, PA (US) 19106

( * ) Notice: Subject to any disclaimer, the term of this patent is extended or adjusted under 35 U.S.C. 154(b) by 0 days.

(21) Appl. No.: 09/169,346

(22) Filed: Oct. 9, 1998

(51) Int. Cl.[7] ..... A45D 8/04; A45D 8/12; A41G 3/00

(52) U.S. Cl. ..... 132/273; 132/275; 132/53

(58) Field of Search ..... 132/273, 274, 132/275, 53, 56, 55; 428/373

(56) References Cited

U.S. PATENT DOCUMENTS 4,777,678 * 10/1988 Moore ..... 5/431
5,164,262 * 11/1992 Kobayashi et al. ..... 428/373
5,308,697 * 5/1994 Muramoto et al. ..... 428/373
5,352,518 * 10/1994 Muramoto et al. ..... 428/373
5,454,270 * 10/1995 Wong ..... 132/275
5,590,422 * 1/1997 Henderson ..... 132/273
5,826,593 * 10/1998 Haubrich ..... 132/128

* cited by examiner

*Primary Examiner*—John J. Wilson
*Assistant Examiner*—Robyn Kieu Doan
(74) *Attorney, Agent, or Firm*—Obermayer Rebmann Maxwell & Hippel LLP

(57) ABSTRACT

A novel hair band is disclosed. The novel hair band comprises a tube having a pre-determined diameter and having a pre-determined length, said tube being constructed with 140 denier lycra wrapped in a 40 denier nylon, said tube being be rolled from both sides so as to form a hair band having two rings. In another embodiment, the invention comprises a system for storing a plurality of hair bands comprising a cylindrical member having a pre-determined outside diameter and having a sufficient length to hold a plurality of hair bands to the exterior of said cylindrical member.

5 Claims, 4 Drawing Sheets

HAIR BAND SYSTEM WITH STORAGE AND DISPLAY DEVICE

FIELD OF THE INVENTION

The present invention is directed to a novel hair band material, hair band and a display and storage device for use therewith.

BACKGROUND OF THE INVENTION

Hair-holding mechanisms have been well known in the prior art for thousands of years. The earliest known hair-holding systems comprised primitive clips made of animal bone and simple cloth ribbons and bows. More recently, a variety of elastic devices have become popular. Many of these devices comprise or include coarse elastic or rubber bands. These elastic devices frequently include charms, jewelry or other small ornamental objects.

Various devices have been developed to fasten hair in a ponytail, braid or a bunch. These devices typically include a fastening element to hold the hair. The decorative fastening element may comprise a ring of metal or other hard material, but is more commonly some form of an elastic band. While these devices are adequate to hold the hair of the wearer, they are frequently coarse and result in the tearing of the hair and the creation of split ends.

A number of earlier hair bands lack rubber bands and/or fastening elements in their construction. Instead, these hair bands utilize the combination of SPANDEX (polyurethane fiber) and a hard yarn—such as nylon, polyester, cotton or acrylic—to form a ring of high stretch material (i.e., a hair band).

SPANDEX can be used in different forms, including bare, air covered and/or double covered. Since bare SPANDEX is most cost effective, its use in hair bands is most prevalent. However, bare SPANDEX, because of its knitting properties, cannot be used and must always be accompanied by at least one hard yarn. While hair bands inclusive of bare SPANDEX adequately hold hair, they are less than ideal, tending: (a) to be cheap in appearance, (b) to have limited use life, and (c) to tangle in hair, for bare SPANDEX often protrudes from their construction.

A number of United States patents have issued which exemplify the use of both elastic and mechanical hair-holding devices. A popular type of fastening or wearing accessory is an endless, annular sleeve or tube of cloth having a rubber band within the sleeve that contracts the sleeve around the hair or body part and creates folds and pleats around the annulus to provide an ornamentation. Such a fastener is shown in U.S. Des. Pat. No. 292,030. The sleeve is expanded to receive a bunch of hair or an ankle or wrist, and on release contracts to secure the hair.

U.S. Pat. No. 5,758,671 similarly discloses a wearing accessory for use as a hair fastener accessory and includes an annular flexible sleeve of cloth surrounding an elastic band in which is provided a central pocket. U.S. Pat. Nos. Des. 296,128 and 291,673 similarly disclose hair bands of this type which include a fabric overlaying an elastic band.

U.S. Pat. No. 5,697,386 is exemplary of mechanical hair holding devices and discloses a hair band of a flexible material, including a body, two hair retaining portions respectively attached to ends of the body and two extension plates respectively attached to the hair retaining portions. This mechanical device includes a slot for adjusting the length of the hair band using the extension plates.

While each of the above devices satisfactorily hold hair, they frequently damage the hair of the wearer, cause headaches and crimp hair. Moreover, accessories such as disclosed in U.S. Pat. No. 5,758,671 are large and relatively obtrusive. Moreover, hair bands such as those that incorporate bare SPANDEX is aesthetically unappealing and get caught in the hair of the wearer.

It would therefore be desirable to provide a hair-holding band lacking bare SPANDEX-constructed rather of covered spandex. Fabric knit wholly and solely of covered SPANDEX would constitute a novel material, never before used by manufacturers of hair bands, which was more stretchable, less damaging to hair, more aesthetically appealing, and more durable than material inclusive of bare SPANDEX.

It would therefore be desirable to provide a hair holding band constructed of a novel material which was both elastic and yet gentle and non-damaging to the hair of the user.

It would further be desirable to provide a novel storage and display system for such a hair band which could both ornamentally store and hold the hair bands in an attractive system.

It is therefore an object of this present invention to provide a novel hair band material and a novel hair band constructed from the aforesaid material.

It is a further an object of the present invention to provide a novel system for storing, packaging and displaying the hair band of the present invention.

These and other objects of the present invention are more fully set forth in the following Summary and Detailed Description.

SUMMARY OF THE INVENTION

In accordance with the present invention, the present invention is directed to a novel material for constructing a hair band. The material comprises solely about a covered SPANDEX of particular denier. The spandex may be air covered, single covered or double covered. The material provides optimal elasticity and is less damaging to hair than material inclusive of bare SPANDEX. The material comprises about a 140 denier LYCRA or spandex wrapped in an approximately 40 denier nylon. The LYCRA or SPANDEX (polyurethane fiber) may be single or double wrapped. The material provides optimal elasticity, but is non-damaging to the hair of the wearer. The use of covered LYCRA or SPANDEX is more aesthetically appealing, is less likely to get caught in the hair of the wearer and allows the hair band to be used on both sides. In a more preferred embodiment, the material of the present invention is woven into a tube having a predetermined length and having an internal diameter of about between one and two inches. In a more preferred embodiment, the material of the present invention is knit into a tube having a pre-determined internal diameter.

In yet a further embodiment, the present invention is directed to a novel hair band comprising a tube having a pre-determined diameter and having a pre-determined length, said tube being constructed with 140 denier spandex wrapped in a 40 denier nylon, said tube being rolled inward from both sides so as to form a hair band having two rings. The rings may be turned either inward or outward for use by the wearer.

The present invention is also directed to a system for storing a plurality of hair bands comprising a cylindrical member, said member having a pre-determined outside diameter and having a sufficient length to hold a plurality of hair bands to the exterior of said cylindrical member. The system may include a box for holding said cylinder. Alternatively, the tube can be provided as a unit and cut by the end user in any desired length.

DETAILED DESCRIPTION OF THE PRESENT INVENTION

The present invention is described with reference to the enclosed Figures, wherein the same numbers are utilized where applicable. The present invention is directed to and includes three discrete components. Initially, the present invention is directed to a novel and unique material for utilization in manufacturing a hair band. In addition, the present invention is directed to a fabricated tube of the aforesaid material which can be cut to create a number of hair bands constructed therefrom. The present invention is further directed to a storage and display system for holding, packaging, storing and displaying the novel hair band of the present invention.

Figure 6:
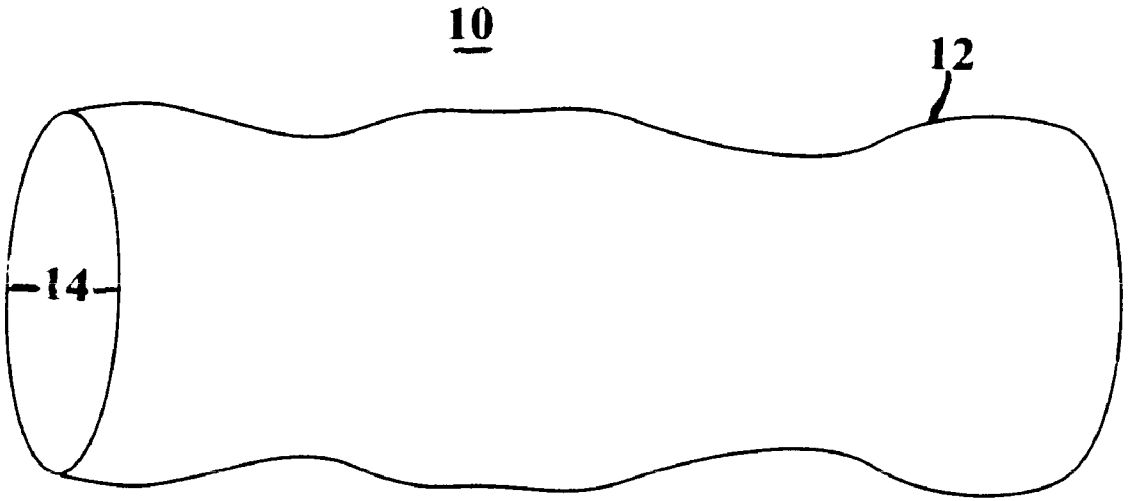
FIG. 6 is a side view of sleeve of the novel material for use in the present invention.
Figure 7:
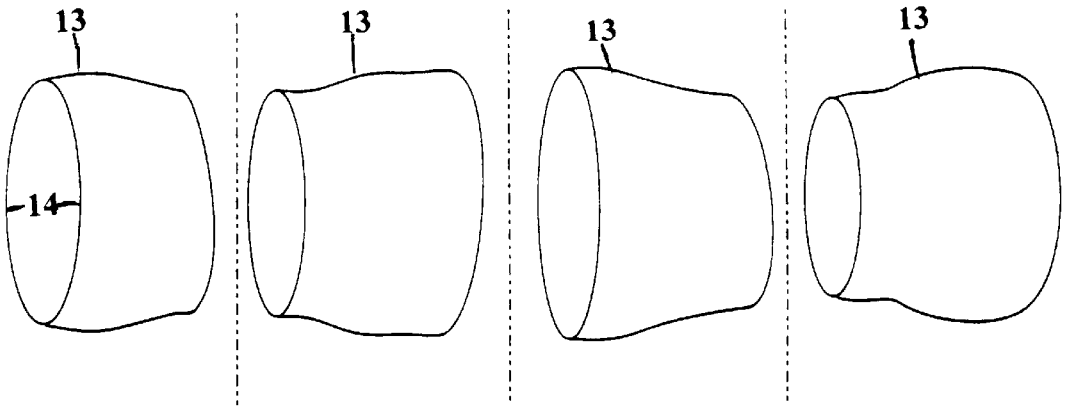
FIG. 7 illustrates the sleeve of FIG. 6 cut into individual hair band segments.
Figure 8:
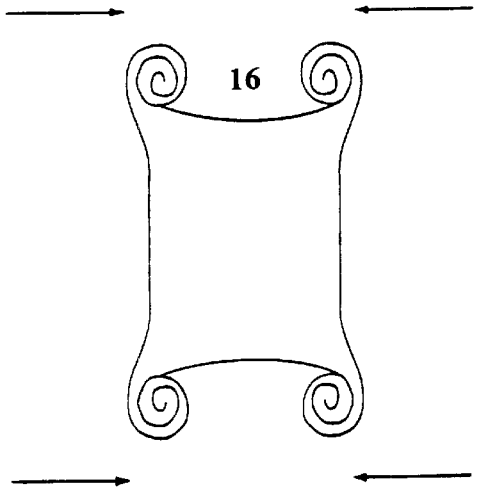
FIG. 8 illustrates the method by which the novel hair band of the present invention is created.

Referring to FIGS. 6–8, a novel hair band material 10 is illustrated. The novel hair band material 10 comprises a novel combination of the synthetic materials of lycra or SPANDEX and nylon. In a preferred embodiment, the combination and LYCRA and nylon comprises the combination of approximately 140 denier LYCRA or SPANDEX (polyurethane fiber) wrapped or covered in approximately 40 denier nylon. The LYCRA or SPANDEX may be single or double wrapped. Such a nylon is referred to as a 34 filament nylon. Alternatively, 20 denier, multiple filament nylon may be used. This combination of LYCRA and nylon, as used in the present invention, has been determined by Applicant to provide the most desirable hair band material and one which does not tear or shear hair with its placement and removal. The product is also less likely to unravel in use. This combination of nylon and LYCRA SPANDEX provides a material which exhibits both flexibility and elasticity, but which is fine enough to be easily and comfortably attached to the hair of the user. The LYCRA or spandex may also comprise 70 denier SPANDEX or LYCRA.

Figure 4:
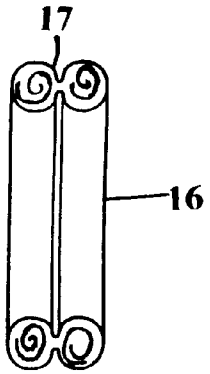
FIG. 4 is section view of the hair band of the present invention.

Referring to FIG. 6, the material 10 preferably comes in a pre-fabricated tube 12 which may have any desired length and may be cut into individual hair band sections 13 as shown in FIG. 7. Preferably, the tube 12 has a pre-determined interior diameter 14, which, as an example, may be between one and two inches. As shown in FIG. 7, the tube is preferably then cut into sections having predetermined lengths 15 which, as a non-limiting example, may be about one to two inches. As shown in FIG. 8, the tube sections 13 are then rolled inward from both ends so as to create a dual conjoined ring hair band 16, as shown in FIG. 4. This is accomplished by stretching and releasing the hair band. The hair band 16, so constructed, can then be easily and comfortably used with the hair of a wearer. The hair band 16 can be used and worn with the rings 17 turned inward or outward. It is to be appreciated that tube 12 may be provided uncut to the end user, who will then cut it into individual hair bands as desired.

Figure 2:
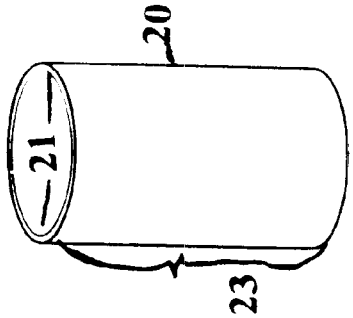
FIG. 2 is an elevational view of a cylindrical holder for use in storing the hair bands of the present invention.
Figure 1:
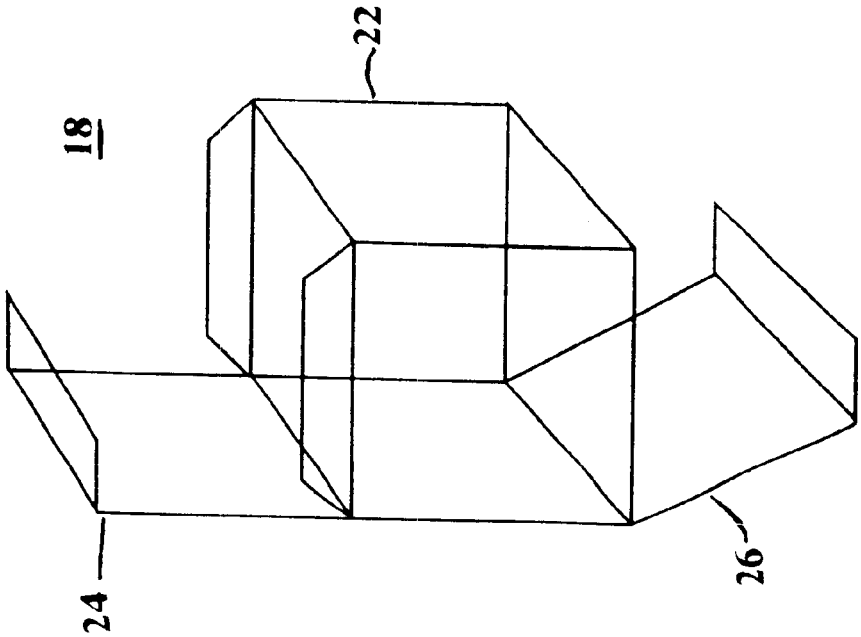
FIG. 1 is a perspective view of a storage box for holding the hair band system of the present invention.

Referring to FIGS. 1, 2, 3 and 5, a novel storage, packaging and display system 18 for the hair bands 16 of the present invention are shown. As shown in FIG. 2, the storage system 18 comprises a cylindrical member 20 having a pre-determined diameter 21. As a non-limiting example, the diameter may be between approximately one and two inches. The cylindrical member 20 should have a sufficient enough length 23 to support or hold a plurality of hair bands 16. The cylindrical member 20 may be constructed from any suitable material, including plastic, paper, cardboard or wood. The cylindrical member may be either hollow or solid.

Figure 3:
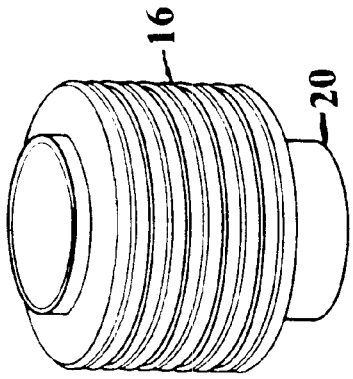
FIG. 3 shows the cylindrical tube of FIG. 2 with a plurality of hair bands.
Figure 5:
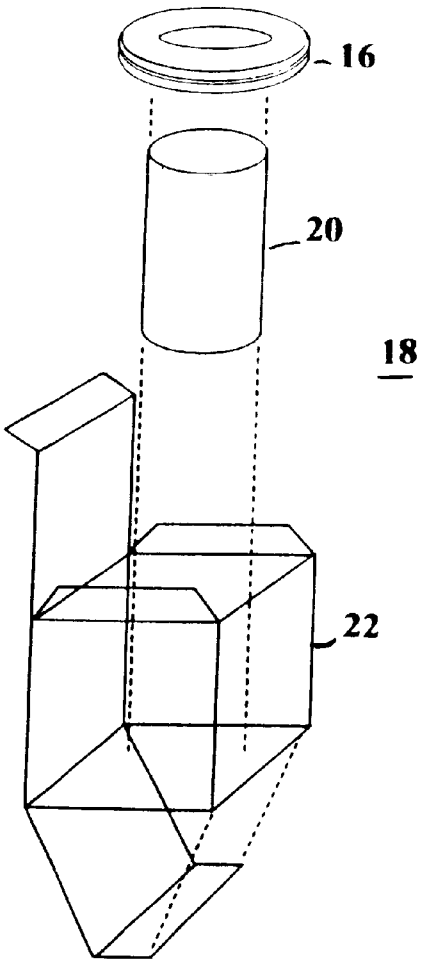
FIG. 5 is an exploded view of the hair band system of the present invention, including storage mechanism.

As shown in FIGS. 3 and 5, the individual hair bands 16 are then placed over the cylindrical member 20 so as to provide an ornamental display and storage system, such as shown in FIG. 3. The cylindrical member 20 and hair bands 16 can then be stored in a clear, translucent, or transparent box 22 which facilitates the ease of storage, packaging and handling. The box 22, which has top and bottom lids 24, 26, may be constructed from plastic, paper or metal.

The present invention has been described with reference to the enclosed Figures. It is to be appreciated that other embodiments of the present invention are suggested by the above discussed preferred embodiment and that the true scope and breadth of the present invention is determined with reference to the attached claims.

I claim:

1. A hair band, comprising:

a tube having a pre-determined diameter and a pre-determined length, said tube being constructed with approximately 140 denier polyurethane fiber wrapped in approximately 40 denier nylon, said tube being rolled inwardly from both ends so as to form a hair band having two conjoined rings.

2. The hair band of claim 1 wherein the conjoined rings of said hair band are turned inwardly.

3. The hair band of claim 1 wherein the conjoined rings of said hair band are turned outwardly.

4. The hair band of claim 1 wherein said pre-determined diameter is between approximately one inch and approximately two inches.

5. A tube of material designed to be cut into a plurality of hair bands, each of said hair bands consisting of a tube having a pre-determined diameter and length, said tube comprising 140 denier polyurethane fiber covered in 40 denier nylon.

* * * * *